United States Patent [19]

Voss

[11] 4,385,567

[45] May 31, 1983

[54] SOLID FUEL CONVERSION SYSTEM

[75] Inventor: George D. Voss, Western Springs, Ill.

[73] Assignee: Solid Fuels, Inc., Western Springs, Ill.

[21] Appl. No.: 200,472

[22] Filed: Oct. 24, 1980

[51] Int. Cl.[3] ..... F23N 5/18

[52] U.S. Cl. ..... 110/186; 110/101 CD; 110/227; 110/257; 110/342; 110/346; 110/347

[58] Field of Search ..... 110/227, 255, 257, 235, 110/101 CD, 342, 343, 346, 347, 186

[56] References Cited

U.S. PATENT DOCUMENTS

| | | | |
|---|---|---|---|
| 2,388,294 | 11/1945 | Shaffer et al. | 110/186 |
| 3,057,309 | 10/1962 | Turner et al. | 110/186 |
| 3,333,556 | 8/1967 | Iacobovici | 110/227 |
| 3,380,408 | 4/1968 | Rivers | 110/257 |
| 3,855,950 | 12/1974 | Hughes et al. | 110/186 |
| 3,937,155 | 2/1976 | Kunstler | 110/255 |
| 4,185,080 | 1/1980 | Rechmeier | 110/343 X |

FOREIGN PATENT DOCUMENTS

| | | | |
|---|---|---|---|
| 55-82214 | 6/1980 | Japan | 110/186 |
| 55-155108 | 12/1980 | Japan | 110/101 CD |
| 744033 | 1/1956 | United Kingdom | 110/101 CD |

*Primary Examiner*—Edward G. Favors

*Attorney, Agent, or Firm*—Laff, Whitesel, Conte & Saret

[57] ABSTRACT

A solid fuel conversion system feeds solid fuel to a burning area at a controlled and metered rate. In the burning area, the solid fuel is dried before it reaches a burning bed of coals. Once it reaches the bed of coals, it is advanced at a controlled rate from said drying means through the area of the burning bed of coals to an ash area. The fuel-drying and advancing is carried out by a series of grates having controlled amounts of grate movement. The drying grate is set at a relatively steep angle (here, 60°) which breaks the free-fall of an incoming curtain of solid fuel. The fuel-advancing is accomplished by a series of grates which are set at less than a free-fall angle (here, 15°). A reciprocating feeder moves the fuel-advancing grates back and forth by the controlled amounts. The controlled rate of advance causes the solid fuel to gasify in the area over the burning bed. An air delivery system controls the flow of gaseous fuel from the solid fuel burning area to a gaseous burning area.

39 Claims, 13 Drawing Figures

MODULE I
MODULE II
ASH CONVEYOR
HORIZONTAL
HORIZONTAL
GASIFYING FUEL 102a
GREEN FUEL 106a
LIMESTONE 114
BURNING BED 100a

FROM ROTARY FEEDER 24
CURTAIN OF NEW FUEL
70
27
26
TERTIARY AIR 110
SECONDARY AIR 108
BURNING GAS 112
BURNING GAS
BURNING BED 100
GREEN FUEL 106
GASIFYING FUEL 102
ASH
ASH
60
58
56
54
52
49
98
92
94
96
PRIMARY AIR
PRIMARY AIR
62
63
64
65
67
$T_1$
$T_2$

SOLID FUEL CONVERSION SYSTEM

This invention relates to fuel conversion and, more particularly, to burners capable of converting a wide variety of solid fuels into energy with a minimum of particulate emission.

With the growing shortage of energy sources, it is desirable to extract energy from any available source. Usually, this means that a fuel is burned in a furnace to generate heat which is converted into steam or some other usable form. At one time, these furnaces were specifically designed to burn a particular solid fuel, such as powdered coal, for example. The furnace could not easily burn any other fuel.

Also, the known solid fuel furnaces are labor-intensive since someone has to remove clinkers, ashes, and the like. If the fuel includes foreign matter, such as rocks or steel bolts, for example, the fuel-feeding mechanism may jam and a shear pin breaks. Then, it sometimes becomes necessary to unload the entire coal bin to back the drive mechanism and remove the foreign matter.

For these and other reasons, solid fuel stokers fell out of favor and have been largely replaced by gas- and oil-fired furnaces. Today, however, gas and oil have come into scarce supply and their costs have increased sharply.

Along with these fuel requirements, modern life-style has generated vast amounts of trash and other waste material which must be eliminated. However, indiscriminate burning led to air pollution. As a result, incinerators have been forbidden to burn much of this trash and waste material.

As a result of these and other considerations, there is now a need for a system which can burn almost any combustible material for the purposes of energy extraction, without pollution, and with little or no need for manual labor.

Accordingly, an object of the invention is to provide equipment for converting a wide variety of solid fuels into efficient energy, with a minimum of particulate emission. Here, an object is to provide flexible and versatile energy conversion systems. In this connection, an object is to provide a completely or nearly completely automatic system which minimizes the need for human supervision and servicing.

Another object of the invention is to provide a sulphur-absorbing material in a system for converting high-sulphur coal to energy, without causing air pollution.

Yet another object of the invention is to provide a system for converting at least some of the burnable portions of urban trash into energy, without causing air pollution.

Still another object of the invention is to provide a system for burning the waste of forest products, such as bark, chips, sawdust, and the like.

Yet a further object is to provide for automatic ash disposal.

A still further object is to provide a modular, skid-mounted system which may be installed, moved or removed quickly and easily.

In keeping with an aspect of the invention, these and other objects are accomplished by a furnace having an automatic feed system which is capable of delivering to a burner almost any relatively solid fuel which can burn on a grate. The grate has four cascaded sections which are positioned to advance the solid fuel, as it burns. The speed and distance of the advance is controlled so that the fuel is reduced to an ash by the time that it reaches the end of the cascade of grates. Air is introduced into, around and under the grate area in a manner which insures full and complete combustion, regardless of the type and style of fuel that is used. When a high-sulphur fuel is burned, limestone, lime, or other sulphur-absorbing materials may be introduced in a manner which completely covers the burning bed to absorb and reduce $SO_2$ from the smoke and gas which is released into the atmosphere. (For convenience of expression, all of these and other suitable sulphur materials will hereinafter be called "limestone.")

The system is modular so that a plurality of systems may be operated in series or in parallel depending upon instantaneous changes in demand for heat.

The nature of the invention will be understood best from the following description of the drawings in which.

Figure 1:
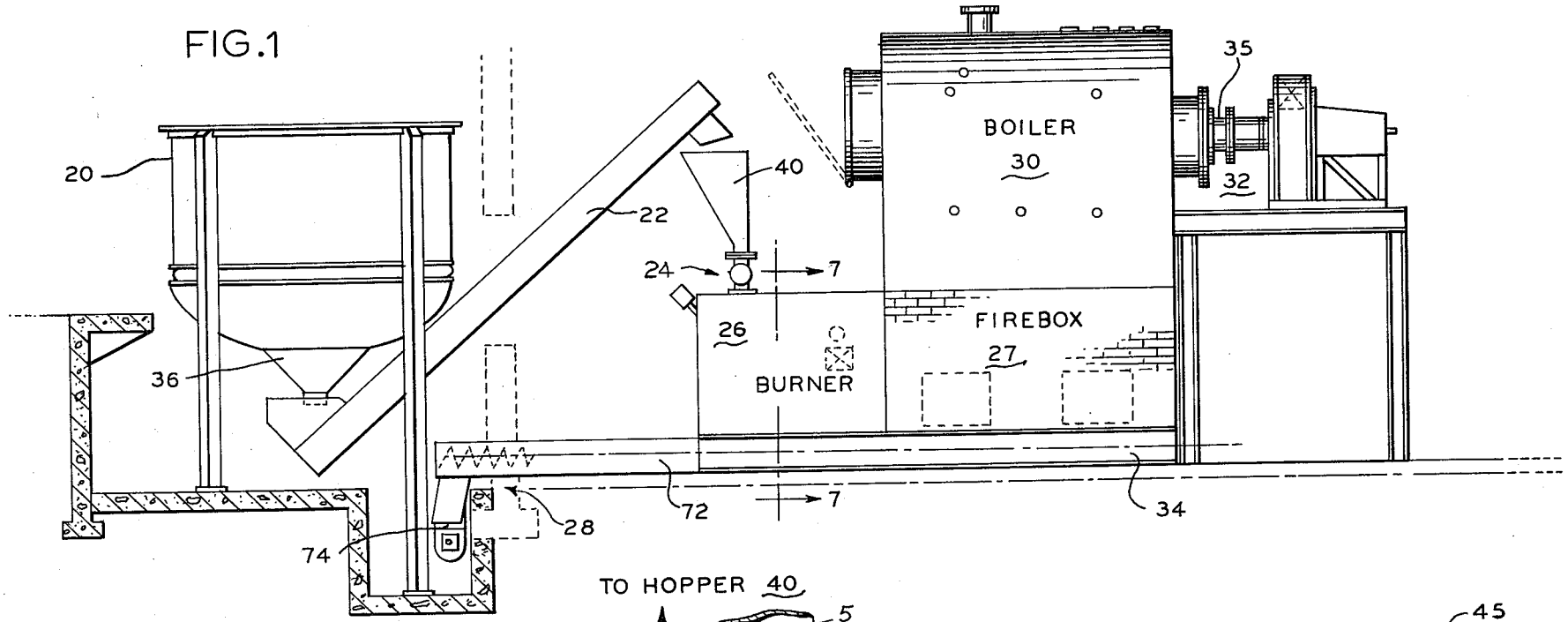
FIG. 1 is a side elevation schematic of the inventive furnace system for converting solid fuels to energy.

The principal subsystems of the inventive furnace (FIGS. 1 and 2) are a fuel storage bin 20, a fuel conveyor 22, a fuel feeder 24, a burner 26, firebox 27, an ash removal system 28, a boiler 30, and a pair of blowers 32, 33. The entire assembly is a series of modules built on one or more skids 34 (here in the form of massive I-beams—see FIG. 7) for easy installation and moving.

The fuel bin 20 may take any suitable form. Preferably, it is a "live bottom" type of bin which means that it contains any suitable mechanical means for insuring that the fuel falls through a funnel-shaped area 36 in the bottom of the bin. From there, a fuel conveyor 22 transports the fuel to a gravity feed hopper 40. Preferably, a screw-type conveyor is used at 22.

Figure 4A:
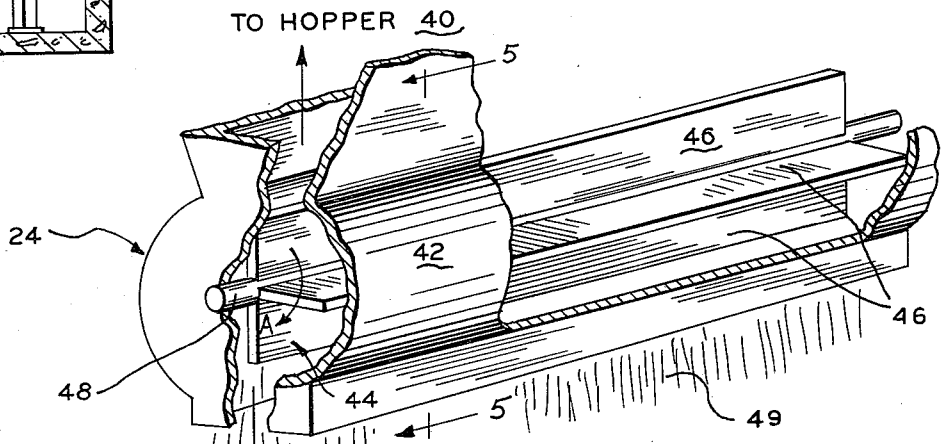
FIG. 4A is a perspective view of a rotary feeder for delivering a curtain of almost any burnable solid fuel into a burner.
Figure 4B:
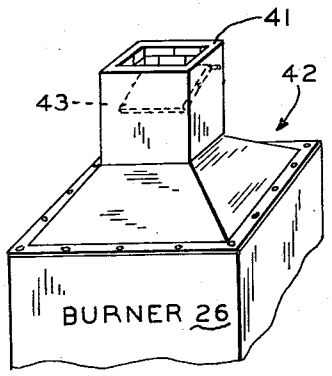
FIG. 4B is a plan view showing two of the systems used in parallel.
Figure 4C:
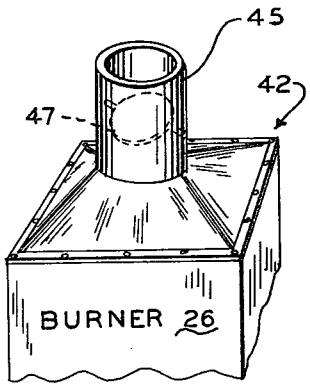
FIG. 4C shows a second alternative feeder which uses the fuel conveyor to meter the incoming green fuel.
Figure 5:
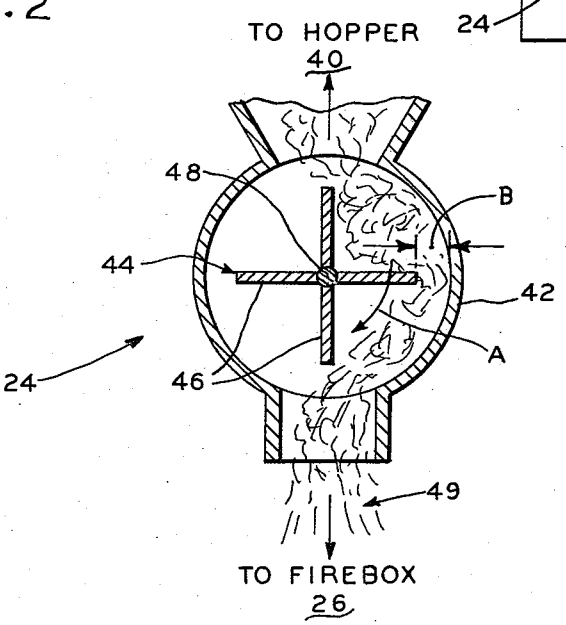
FIG. 5 is an elevation view (taken along line 5—5 of FIG. 4A) showing a rotary feeder in cross section.

Beneath hopper 40 is a feeder 24 which is seen in detail in FIGS. 4, 5. This feeder includes a generally cylindrical sheet metal or metal plate housing 42 having an open top leading to hopper 40 and an open bottom leading to burner 26. All of the housings 42 have the same flange and bolt hole patterns so that they may be substituted for each other. The feeder design depends upon the fuel which is used.

In FIGS. 4A, 5, a star wheel rotor 44 is mounted along the longitudinal axis or the center of the cylindrical section 42. This star wheel rotor 44 has a plurality of flat blades, vanes or paddles extending outwardly from a central axis 48. Thus, as the rotor 44 turns in direction A, fuel falls under gravity from hopper 40 and onto the pockets between blades 46. The turning of the rotor 44 deposits metered amounts of this fuel into the burner 26. Unlike most rotor feeders, there is a substantial clearance B (FIG. 5) between the outer edge of the blade and the inside surface of the cylindrical housing 42. Thus, a solid fuel material such as bark, or the like, may tend to overflow and wrap around the edges of the blades and still feed through housing 42.

The rotary feeder is thus different from other feeders in that the fuel—not the blades—forms an air lock for containing most of the air which is pumped into the firebox to support combustion. The exact amount of clearance B may vary with the fuel being used. Therefore, the invention contemplates a provision of a plurality of different size rotors 44 which may be substituted for each other. If the fuel is changed from, say, a porous shaggy bark to a non-porous powdered coal, the rotors are switched so that the clearance B is appropriate to the fuel which is being burned.

Figure 7:
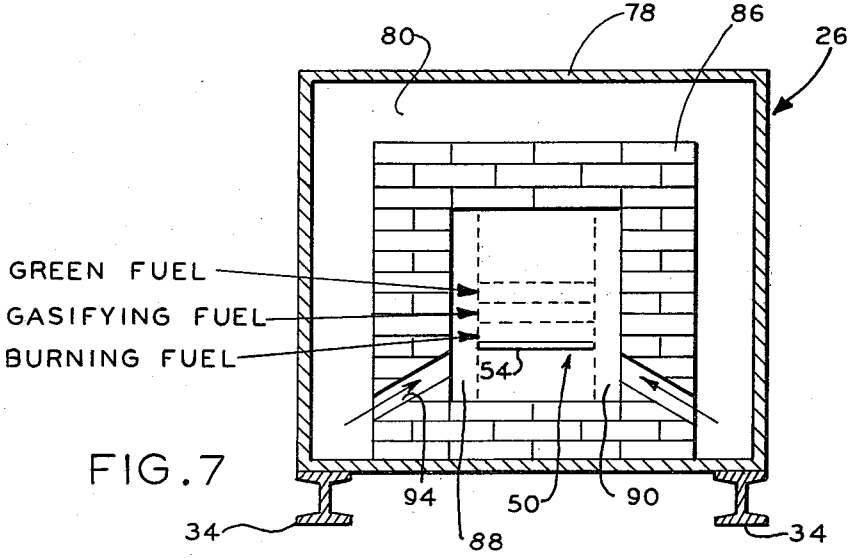
FIG. 7 is a cross-sectional, schematic, elevation view (taken along line 7—7 of FIG. 1) of the burning bed and air delivery arch of the inventive furnace.
Figure 6:
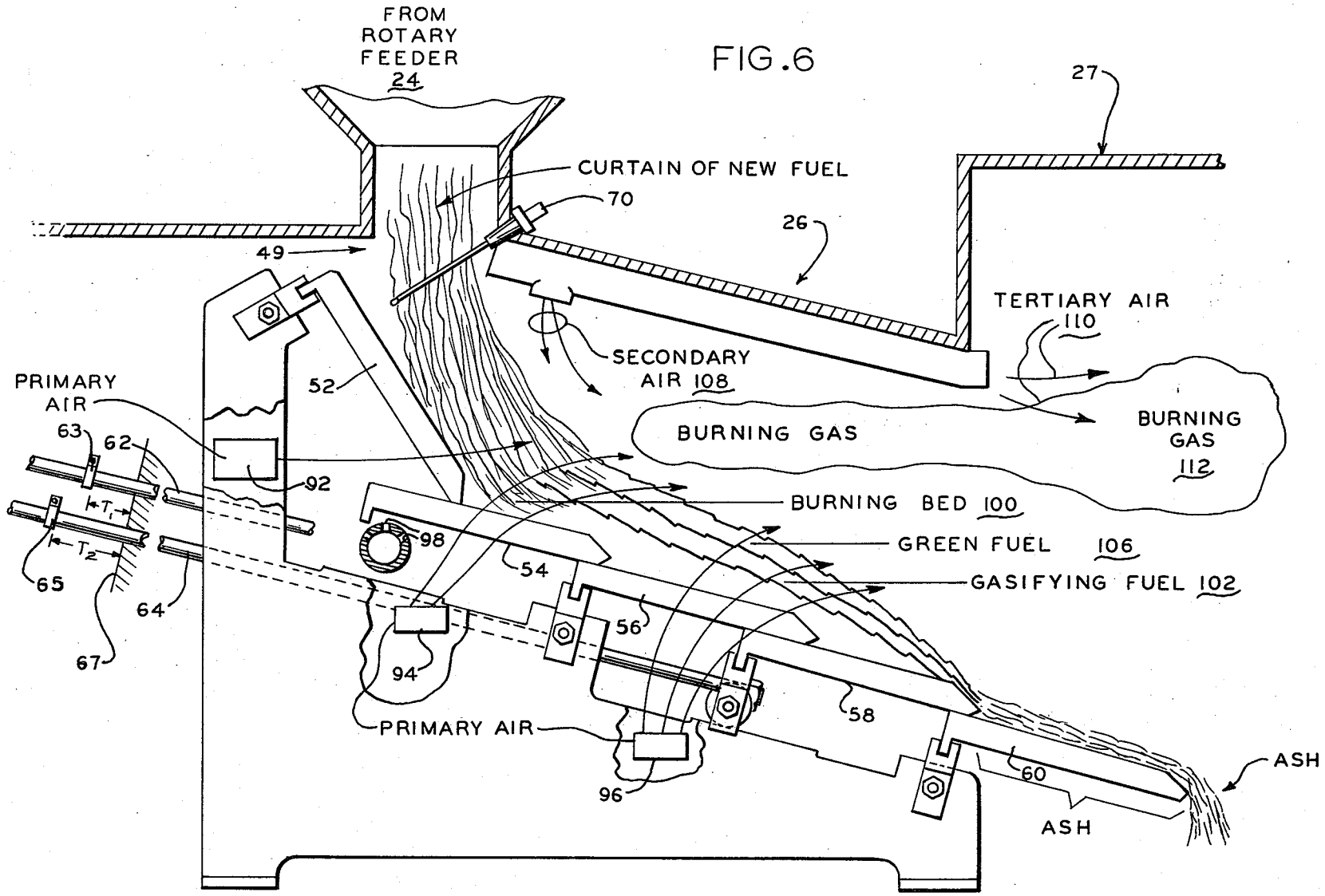
FIG. 6 is a stylized cross-sectional view of the burner area of the inventive system.

As the rotary feeder 24 deposits the fuel 49, it falls as a curtain into burner 26. The rotary feeder 24 spreads the fuel 49 fairly uniformly across the width of the curtain. Therefore, the fire bed is spread fairly uniformly across the width of the burning area 50 in burner 26 (FIGS. 6, 7).

In FIG. 4B, the feeder 42 is merely an inverted, somewhat funnel-like housing which is, preferably, lined with a refractory material 41 to block the outward flow of heat, if live coals fall therethrough. Inside the housing, a damper 43 is arranged to block the backward flow of air or combustible gas into hopper 40.

This embodiment of the feeder may be placed at the output or ash disposal end of some other solid fuel-burning system. For example, an analysis of live coals or ash taken from many older systems, which were designed before the energy crisis developed, shows an extremely high carbon content. This carbon can be deposited as live coals into the burner of the inventive system where it is converted into energy since this system has an energy conversion efficiency which is much greater than older systems.

Thus, the live coals, ash and carbon output from the firebox of some other system is dumped directly into the refractory-lined feeder 42 of FIG. 4B, when it depresses damper 43 during the time required for fuel to enter the burner 26. As soon as the ash and carbon pass, the damper 43 automatically closes again.

FIG. 4C shows a similar system for use with solid fuels which do not require either the rotary feeder of FIG. 4A or the refractory feeder of FIG. 4B. Here, the solid fuel is dumped from the hopper 40 directly through an intake chute 45 to the feeder.

The dampers 43 (FIG. 4B) and 47 (FIG. 4C) perform the same function. However, damper 43 pivots about one edge and damper 47 pivots around its center. Either style may be selected depending upon the characteristics of the incoming solid fuel. For example, shaggy bark might drape over damper 47 and make it inoperative. On the other hand, some granular fuels spread themselves better if the stream is divided into two parts by the damper 47.

If the feeders of FIGS. 4B, 4C are used, the conveyor 22 is run intermittently to meter the flow of fuels into the burner 26. The reciprocal motion of the grates spreads the fuel uniformly throughout the fuel bed.

Figures 3A, 3B, 3C, 8, 9:
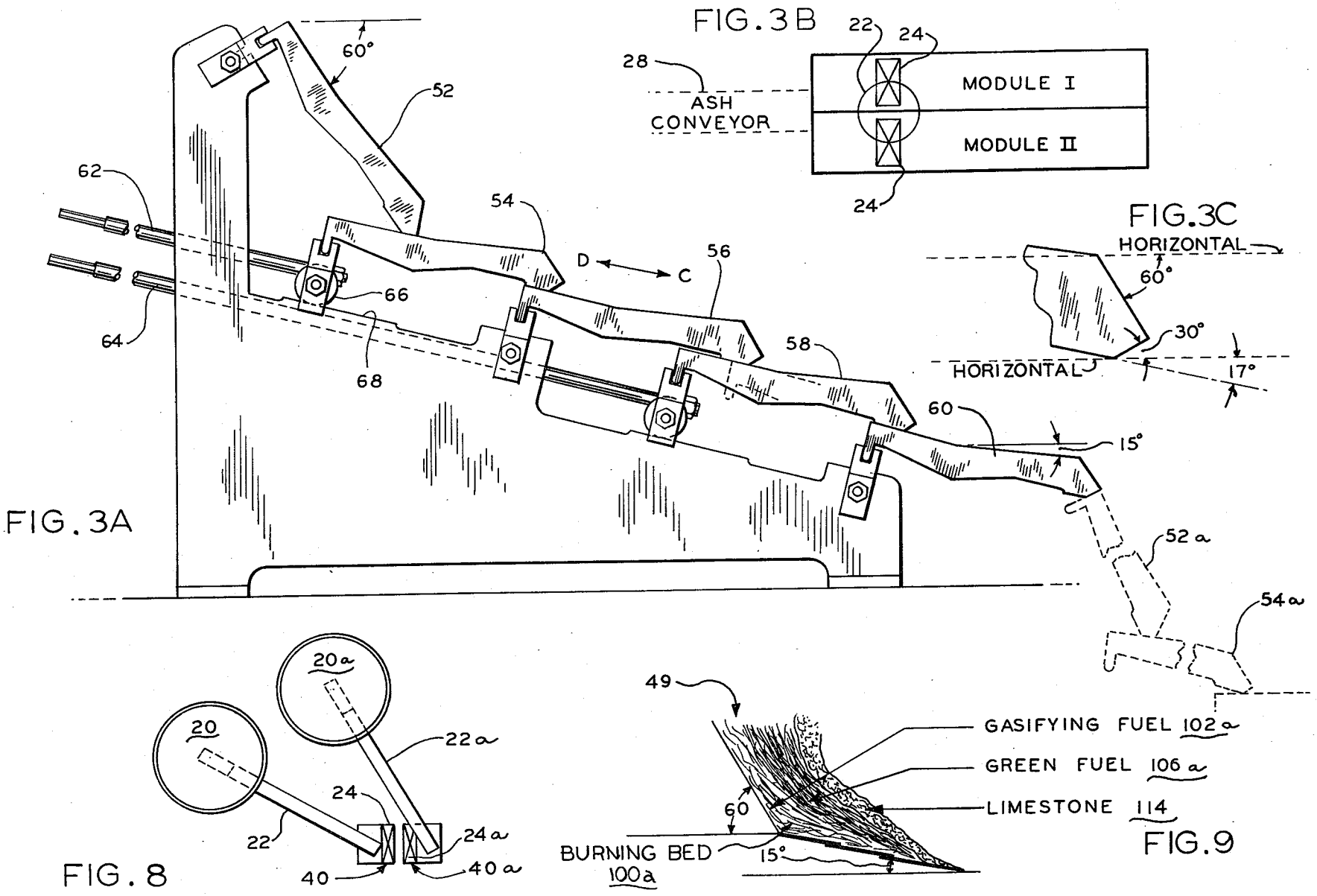
FIG. 3A is a side elevation of four cascaded grates using a reciprocating plate feeder design, with provisions for an additional series or cascade of four more grates for large-scale burning.
FIG. 3B is a plan view showing two of the systems used in parallel.
FIG. 3C is an enlarged view of the tip of the grate sections.
FIG. 8 is a top plan view of a portion of a system using a sulphur-absorbing (such as limestone) feeder.
FIG. 9 is a schematic elevation view of the burning bed of the inventive furnace with limestone added thereto.

The burner 26 contains a system of cascaded grates that is best seen in FIG. 3A. As here shown, the grate system includes five sections 54–60. The first grate section 52 sits at a preferred angle of approximately 60° with respect to the horizontal, which is an ideal free-fall angle in a usage such as this. Therefore, fuel falls, without avalanching, from grate section 52 to grate section 54. Each of the sections 54–60 sits at about 15° with respect to the horizontal. In effect, the grate 52 breaks the free fall of the incoming fuel deposited by rotary feeder 24 and then acts as a drying rack for the fuel. This is not to say that the actual burning is necessarily restricted to any specific area of the grate system.

The tip ends of each grate section are formed as shown in FIG. 3C. The upper surface is the ideal 60° free-fall angle for the fuel and structure used in the invention. The lower angle 30° is complementary to the 60° angle at the point where the free-fall fuel-drying grate 52 rests upon the inclined burning grate 54.

When the burning area must be lengthened to add to the burning time for any particular fuel or for greater heating demands, a second series of grates **52*a*, 54*a*, . . . (FIG. 3A) are added at the ash output end. Here again, the lower 30° angle at the tip end of the grate 52*a* rests firmly upon the upper surface of the burning grate 54*a***.

Sometimes, the heating demands fluctuate greatly. Therefore, two or more of the described modular systems may be placed side by side, as FIG. 3 shows modules I and II placed side by side. Each module has its own feeder system 24 and shares an input fuel conveyor 22 and output ash conveyor 28 with the other modules. When the demand for heat is low, only one of the modules is used. When the demand is high, both modules come into operation.

Thus, the system may be enlarged either by placing a plurality of modules side by side, as in FIG. 3B, or by adding new cascaded grate sections, as shown at **52*a*, 54*a***.

The (60°) incline on the first grate 52 provides a gravity free-flow angle for even the most difficult solid fuel materials. The second and subsequent grates 54–60 are at an (15°) angle which provides for flow controllability for most materials. The angle of 15° provides some impetus to fuel flow and angular resistance to gravity flow of siftings through the grate sections. A mechanical action of the grate system may be varied by adjusting the length of a mechanical stroke and the timing of the strokes. These variations provide the equivalent of a mechanical adjustment of the angle of the grates 54–60. This way, the ash may be analyzed to determine whether the fuel remains in the burning region long enough for full and complete combustion.

Each of the cascaded grate sections 54–60 is mounted for a reciprocating plate feed, somewhat as taught on page 10–78 of the Marks "Standard Handbook for Mechanical Engineers" (Seventh Edition), McGraw-Hill Book Company. More particularly, a number of arms 62, 64 periodically move the grates 54–60 back and forth (directions C, D), with a maximum travel on the order of two to eight inches, for example. Adjustable collars 63, 65 may be moved up or down the arms 62, 64 to adjust the length of the grate travel stroke. For example, arm 62 and collar 63 will reach a stop 67 after a short travel T1, while arm 64 and collar 65 will reach stop 67 after a long travel T2. If collars 63, 65 are moved back or forward on arms 62, 64, the stroke is lengthened or shortened, in order to accommodate different fuels having a variety of characteristics.

When the grates 54–60 move forward (direction C), the fuel material resting on them also moves forward. When the grates move back (direction D), the fuel is restrained from moving by the following fuel which fell from grate 52, as the grates 54–60 moved forward, and now blocks the backward travel.

In greater detail, the back end of grate 54 is supported by a wheel 66 which rides on a rail 68. The front end of grate 54 rests directly on and slides over the upper surface of grate 56. The lower end of grate 52 rests on and slides over the surface of grate 54. Therefore, as arm 62 moves back and forth, grate 54 also moves back and forth, rolling on wheel 66 and sliding over the surface of grate 56. The end of grate 52 slides over grate 54, and acts as a scraper. The remainder of the cascaded grate 56–60 are mounted in a similar manner, which is apparent from a study of FIG. 3.

The curtain 49 (FIG. 6) of solid-fuel free-falls from hopper 40 (FIG. 1), through rotary feeder 24 (FIG. 4), and onto grate 52. As the curtain of material 49 so falls, it passes a level sensor 70 (FIG. 6), if provided. This sensor includes a probe which is put into mechanical oscillation and, thereafter, the oscillations are detected. When the fuel reaches the level of the sensor, the oscillations are damped, and that damping is detected. The sensor is a commercially available product of Automation Products, Inc., 3030 Max Roy Street, Houston, Texas 77008. When the sensor 70 detects a low level of fuel 49, the rotary feeder 24 is driven to deliver metered amounts of fuel until the fuel level, within the burner 26, is restored, which damps motion of the probe of sensor 70.

Thus, the rotary feeder 24 introduces a curtain of solid fuel which falls more or less uniformly over the width of the burner inlet. This curtain effect distributes a substantially uniform amount of material over the width of the grate section and aids in producing a uniform fuel bed which enhances burner performance. The rotary feeder 24 also provides an assured positive fuel flow and insurance against fuel avalanching, as is typical with many gravity-fed burners. The rotary feeder may have an adjustable timer control to drop the fuel periodically, as may be selected according to the weather. The timer may have a self-adjusting feature to reduce feed if an over-feed of fuel should build up.

In the feeders of FIGS. 4B and 4C, the fuel is such that the normal grate motion distributes the fuel more or less uniformly across the width of the burning bed. The dampers 43, 47 block the back flow of air and the conveyor 22 meters the inflow of solid fuels.

If desired, the fuel level may be electronically controlled to adjust the thickness of the fuel bed by providing a high-limit shutoff at adjustable bed depths.

Sometimes, it is desirable to provide a level sensor plus a variable time delay control. Thus, if there is a demand for fuel, there may be a delay during which the grates may be actuated in order to clear space for green fuel to be deposited on the burner.

The cascaded grates are designed to deliver air across approximately 4½% of the entire burning area through quarter-inch holes more or less uniformly distributed throughout. These air holes provide uniform air distribution beneath the cascade of grates 52–60 and a minimum of sifting of combustibles through the grates, due to the relatively small air openings. The inclined angle of all grate sections also has a strong effect on reducing siftings by providing an angular resistance to gravity flow of fuel. The first inclined grate 52 (60°) meets the second inclined grate (15°) and acts as a scraper which minimizes the transfer of combustible directly into the ash pit.

A distinction is made within the burner unit between the gasification grates 52–56 and the ash discharge grates 58–60. The gasification section enables fuel predrying and gasification. The ash discharge section provides additional time for combustion of material that is not completely consumed on the gasification grate section. The completely combusted material is automatically discharged from the ash discharge grate 60 into an ash pit.

The unit is designed for continuous ash discharge and can handle a wide variety of higher ash fuels and inert materials (e.g., lime and limestone). More particularly, the ash falling off the end of the grate 60 is conveyed by a screw conveyor 72 (FIG. 1) to a conveyor belt 74, from which it is deposited in an ash pot. The rate at which fuel and air are fed into the burning area controls the completeness of the combustion and, therefore, the ash formation.

Figure 2:
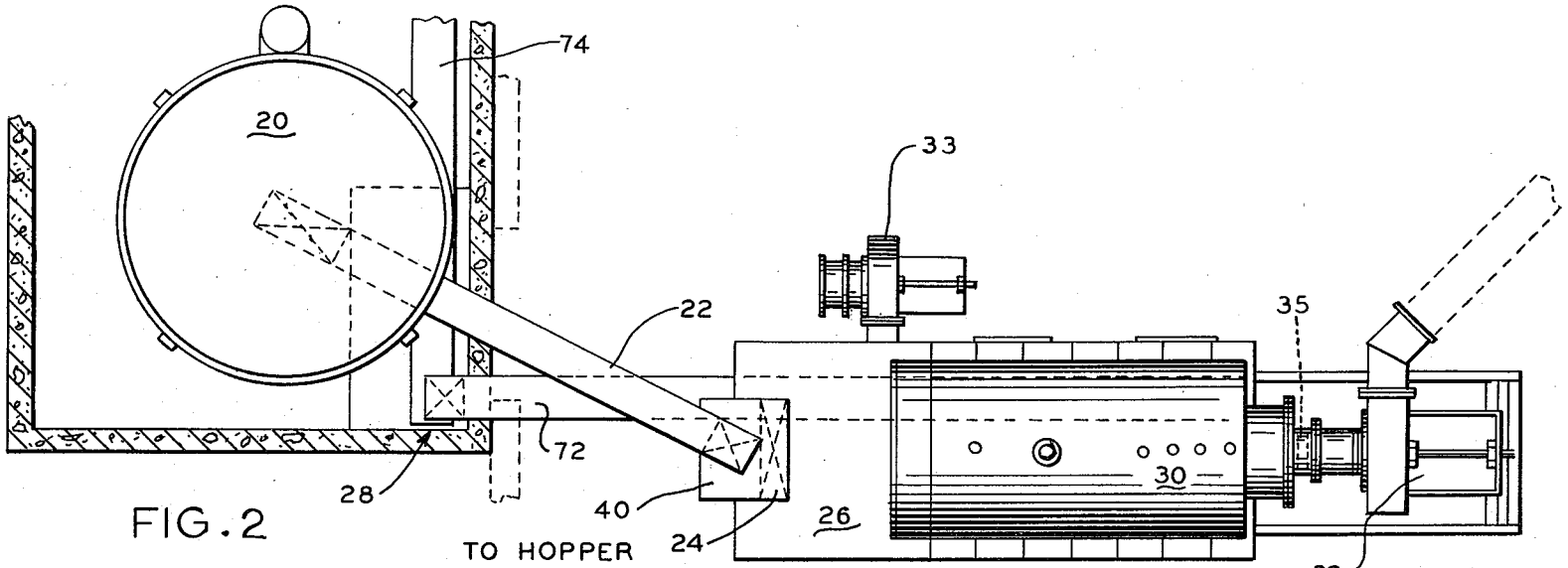
FIG. 2 is a top plan view of the furnace of FIG. 1.

The air delivery is controlled by a fan 33 which blows the combustion air into the burner 26 (FIG. 2). The fan 32 draws the air, smoke, etc. from the firebox 27 and on up the chimney. When the automatic controls of the system call for more or less furnace draft, this fan 32, through an inlet damper control 35, responds to create a negative back pressure in the firebox.

FIG. 7 schematically shows the air delivery system and burning area of the furnace in cross section. The outside walls 78 of the furnace surround an arch-shaped air duct 80 which delivers a curtain of incoming air around the periphery of the firebox. The walls 78 are preferably steel and they rest on two I-beams 34, 34 which form skids for enabling an easy transportaion of the furnace. Inside the air duct arch 80, there is a lining of refractory material 86, which may be firebrick, for example. The cold air in the duct 80 maintains a curtain 88, 90 of relatively less hot air near the firebricks 86 inside the burner 26. Therefore, the burner tends to be much cooler along its sidewalls, which minimizes or avoids a formation of clinkers which may adhere to the sidewalls. This minimization eliminates one of the greatest single requirements for manual labor on solid fuel furnaces of this type.

Air control is emphasized in the burner design. Damper controls are positioned within the air delivery system to divide the incoming air into primary, secondary and tertiary air which is introduced throughout the burner unit. The primary air is introduced at three points 92, 94, 96 (FIG. 6) to provide a directional adjustment of air flow through the upper gasification, lower gasification and ash discharge grate sections 52–60. Initially, the air flow is adjusted by manual dampers. Thereafter, the air flow may be modulated responsive to an automatic air control. The quantity of introduced air can be modulated over a wide range and this modulation is the primary method for controlling energy output.

In greater detail, the flow of air is shown in FIG. 6 by arrows rising through the grates 52–58 to support combustion. The fire is initially started by a pipe burner 98, which is a simple pipe that extends across the full width of the burner. This pipe delivers a fuel, such as propane gas through a series of perforations 98, which ignites the fuel to start the solid fuel to burning. As soon as the solid fuel ignites, and a suitable bed of coals exists, the pipe burner is turned off. Thereafter, the burning process is self-perpetuating.

As the solid fuel burns, the air is adjusted so that there is a burning bed 100 of coals topped by a layer 102 where the solid fuel is gasified or, in effect, vaporized without complete burning at this point. A gasification layer 104 of solid fuel also exists at or near the junction between the free-falling fuel on grate 52 and the reciprocally fed fuel on grates 54–60. The gasification layer 102 is covered by a layer 106 of green fuel. This gasification produces a draft of burnable gas which is directed by secondary air 108 and tertiary air 110 into an area 112 within the firebox 27, where the gasified fuel burns with intense heat. The tertiary air causes additional turbulence and assures complete combustion. By the time that the solid fuel reaches grate 60, it is completely reduced to an ash that falls off the edge and into the ash delivery system. The gasification process is such that the fuel bed itself acts as the particulate control device.

The rate of air flow is adjusted until this form of burning is established. Then, the process continues substantially without change, as long as the solid fuel is fed into the burner 26.

FIGS. 8, 9 show how the system is modified to burn high-sulphur coal with sharply reduced air pollution. More specifically, the unit of FIG. 1 is coupled to an additional bin 20*a*, conveyor 22*a*, hopper 40*a* and rotary feeder 24*a* to provide for $SO^2$ control by an introduction of a curtain of lime or limestone over the fuel bed. These additional units (identified by reference numerals with the suffix "a") are essentially the same as other previously described units bearing the same reference numerals without the suffix "a."

Lime or limestone is fed from bin 20*a* through conveyor 22*a* to hopper 40*a* and rotary feeder 24*a*. The rotary feeder 24*a* deposits a curtain of limestone which forms another layer 114 over the green fuel 106*a* (FIG. 9) in the burner 26. Therefore, as the air (depicted by arrows in FIG. 6) rises from the vents 92–96, the gasified solid fuel material must pass through the limestone which filters out the $SO^2$. The spent limestone in layer 114 falls off the end of grate 60 and is conveyed away in the same manner that the ash falls off.

The advantages of the invention should now be clear. The low-emission burners rely upon gasification of solid fuel which, in turn, depends upon the flow controllability of solid fuels coupled with a control over the amount and location of combustion air flow. The solid fuel flow control results from the angular positions and movement of the grates, wherein grate 52 breaks the free-fall and dries the incoming fuel, while grates 54–60 advance and gasify the fuel at a controlled rate. The rate at which fuel is introduced through the rotary feeder, the rate at which the grate movement feeds fuel, and the rate at which ash is removed from grate 60 all determine the depth of the bed of fuel. While combustion air control is the primary method of varying energy output, bed depth also controls the rate at which the heat is produced.

Those who are skilled in the art will readily perceive how to modify the system. Therefore, the appended claims are to be construed to cover all equivalent structures which fall within the true scope and spirit of the invention.

I claim:

1. A solid fuel gasifying energy conversion system comprising means for delivering solid fuel from a feeder to a burning area at a controlled rate; means for advancing a bed of said solid fuels at a controlled rate from said fuel delivery means through an area containing a bed of coals to an ash area; means in said area containing said bed of coals for drying said solid fuel before it reaches said burning bed of coals; said means for delivering and said means for advancing causing said bed of solid fuel to form an underlying burning layer which is said bed of coals, an intermediate layer where said solid fuel gasifies while it is in said burning area and while it is over the bed of coals, and an overlaying green fuel layer; and combustion air delivery means for uniformly supplying primary combustion air throughout said bed of solid fuel as it advances from said fuel delivery means at said feeder through said advancing means, and means for supplying secondary combustion air for controlling the flow of said gasified fuel from the burning area where the controlled rate of advance occurs to a gaseous burning area.

2. The system of claim 1 and means in said solid fuel burning area for drying said solid fuel before it reaches a burning bed of coals, said drying and fuel-advancing means being a cascaded series of grates, said drying means being a grate set at a relatively steep angle which breaks a free-fall of incoming solid fuel and said advancing means being a series of grates set at less than a free-fall angle, and means for reciprocating said series of grates for moving said solid fuel in said controlled rate of advance.

3. The system of claim 2 and rotary feeder means positioned above said grate set at a relatively steep angle to deliver in metered amounts a curtain of solid fuel to said grates.

4. A solid fuel conversion system comprising means for feeding solid fuel into a burning area at a controlled and metered rate, means in said solid fuel burning area for drying said solid fuel before it reaches a burning bed of coals, said drying means comprising a grate set at a relatively steep angle which breaks a free-fall of incoming solid fuel, means for advancing said solid fuels at a controlled rate from said feeding means through the drying means and the area of said bed of coals to an ash area, said advancing means being a cascaded series of grates set at less than a free-fall angle, said controlled rate of advance causing said solid fuel to gasify while it is over the burning bed, refractory-lined feeder means positioned above said grate set at a relatively steep angle for introducing live coals to said grates, means for reciprocating said series of grates for moving said solid fuel in said controlled rate of advance, and combustion air delivery means for controlling the flow of gasified solid fuel to a gaseous burning area.

5. The system of claim 4 and conveyor means for delivering solid fuel in metered amounts to a position above said grate set at a relatively steep angle.

6. The system of claim 4 wherein said solid fuel is burned at a rate which successively establishes a plurality of layers from the bottom to top, beginning with a burning bed of coals, covered by a gasifying layer of solid fuel, and topped by a layer of green fuel.

7. The system of claim 6 and means for depositing a layer of sulphur-absorbing material over said green fuel for removing $SO^2$ from the gasified fuel.

8. The system of claim 6 and means for automatically conveying ash away from said ash area.

9. The system of claim 6 and means for modularly mounting said system for easy transportation.

10. The system of claim 6 and means for modularly mounting said system, a plurality of said modules sharing a fuel input and an ash output.

11. The system of claim 6 and means for cooling areas on opposite sides of said burning bed for minimizing a formation of clinkers which otherwise could adhere to adjacent surfaces.

12. The system of claim 6 and means for sensing the level of solid fuels in said drying area, and means responsive to said sensing means for selectively adding more of said solid fuel.

13. The system of claim 12 wherein said sensing means comprises an oscillating probe, the oscillations of which are damped by said solid fuel when it reaches a predetermined level.

14. The system of claim 6 and means for delivering said solid fuel on a timed basis.

15. The system of claim 4 and means for adjusting the rate at which said solid fuels advance through said burning bed.

16. The system of claim 4 wherein said relatively steep angle is in the order of 60° and said less than free-fall angle is on the order of 15°.

17. The system of claim 16 wherein each grate has tip ends with an upper angle on the order of 60° and a lower angle in the order of 30°.

18. A method of converting solid fuel into energy comprising the steps of:

a. feeding solid fuel into a burning area at a controlled rate, b. drying said solid fuel in said burning area before it reaches a burning bed of coals, c. advancing said solid fuels at a controlled rate through an area containing a bed of coals to an ash area, and supplying primary air at one level for causing said solid fuel to burn at a rate which establishes a plurality of successive layers from the bottom to top, beginning with said burning bed of coals, covered by a gasifying layer of solid fuel, and topped by a layer of green fuel, d. delivering controlled amounts of secondary combustion air in a location and level which is different than the location and level of the primary air supply for driving the flow of gasified fuel to a gaseous burning area, and e. burning said gassified fuel with an intense flame responsive to a supply of tertiary air in said burning area.

19. The system of claim 5 and means responsive to a demand for heat for controlling the rate at which said fuel feeding means introduces said fuel and for controlling the rate at which said fuel advancing means advances fuel through the burning area in order to determine the depth of the bed of fuel and thereby control the rate at which heat is produced.

20. The system of claim 12 and means responsive to a demand for heat for controlling the rate at which said fuel feeding means introduces said fuel and for controlling the rate at which said fuel advancing means advances fuel through the burning area in order to determine the depth of the bed of fuel and thereby control the rate at which heat is produced.

21. A method of converting solid fuel into energy comprising the steps of:

a. feeding solid fuel into a burning area at a controlled rate, b. drying said solid fuel in said burning area before it reaches a burning bed of coals, c. advancing said solid fuels at a controlled rate through an area of a bed of coals to an ash area, said solid fuel burning at a rate which establishes a plurality of successive layers from the bottom to top, beginning with said burning bed of coals, covered by a gasifying layer of solid fuel, and topped by a layer of green fuel, d. delivering controlled amounts of combustion air in a plurality of different locations and levels for controlling the flow of gasified solid fuel to a gaseous burning area, and e. delivering said solid fuel to the burning area at a timed rate, and f. introducing combustion air through uniformly distributed air holes in a grate supporting said bed of coals, the air distribution being controlled at least in part by a depth of the fuel bed in the burning area for providing a substantially uniform distribution of air to support combustion of said fuel in said burning area.

22. The method of claim 21 and the added step of forming a layer of sulphur-absorbing material over said green fuel for removing $SO^2$ from the gasified fuel.

23. The method of claim 21 and the added step of automatically conveying ash away from said ash area.

24. The method of claim 21 and the added step of cooling areas on opposite sides of said burning bed for minimizing a formation of clinkers which otherwise could adhere to adjacent surfaces.

25. The method of either one of the claims 22 or 23 and the added steps of sensing the level of solid fuels in said burning area, and of selectively adding more of said solid fuel responsive to said sensing means in order to maintain the successive layers of step c.

26. The method of any one of the claims 22 or 23 and the added step of delivering said solid fuel to the burning area at a timed rate.

27. The method of claim 21 and the added step of responding to a demand for fuel by controlling the rates of feeding and advancing set forth in steps a. and c. in order to adjust the depth of the fuel bed.

28. A solid fuel conversion system comprising means for introducing fuel into said system responsive to a demand for heat, means for moving said introduced fuel into and through a burning area at a controlled rate which establishes a bed depth that controls a stratification of the fuel in the burning area, the stratification maintaining the heat in the burning area at a temperature which gasifies said fuel in one stratification without complete combustion in that layer, and means for removing ash after said fuel passes through said bed, said means for introducing and said means for moving automatically control the depth of a resulting bed of fuel in said burning area to regulate the gasification of said fuel as a function of energy demand.

29. The solid fuel conversion system of claim 28 and means for supplying combustion air to at least a region under said bed whereby the automatically controlled depth of said bed regulates and distributes combustion air through said stratifications of the fuel in said burning area to accommodated varying fuel characteristics, including dimensional fuel variations.

30. The solid fuel system of claim 28 or 29 and means comprising a burning fuel supporting member having a plurality of relatively small air holes substantially uniformly distributed under said bed, whereby said distribution of air is made more uniform.

31. The solid fuel conversion system of claim 28 or 29 and time delay means responsive to said demand for providing a time interval beginning with grate movement and ending with said introduction of fuel.

32. The solid fuel conversion system of claim 28 or 29 wherein said means for moving fuel comprises means for moving fuel with adjustable stroke.

33. The system of claim 28 wherein said bed depth is selected to establish a first strata of burning fuel having an overlying second strata of gasifying fuel, and said second strata having an overlying third strata of green fuel, with combustion air blowing said gasifying fuel through said green fuel and into a burning gas area.

34. A method of converting solid fuel into energy comprising the steps of:

a. feeding solid fuel into a burning area at a controlled rate, b. drying said solid fuel in said burning area before it reaches a burning bed of coals, c. advancing said solid fuels at a controlled rate through an area of a bed of coals to an ash area, said solid fuel burning at a rate which establishes a plurality of successive layers from the bottom to top, beginning with said burning bed of coals, covered by a gasifying layer of solid fuel, and topped by a layer of green fuel, d. delivering controlled amounts of combustion air in a plurality of different locations and levels for controlling the flow of gasified solid fuel to a gaseous burning area, and e. cooling areas on opposite sides of said burning bed for minimizing a formation of clinkers which otherwise could adhere to adjacent surfaces.

35. The method of claim 21 and the added steps of controlling the rate at which said fuel feeds into said burning area in step a. responsive to a demand for heat, and for controlling the rate at which said fuel advances through the burning area in order to determine the depth of the bed of fuel and thereby control the rate at which heat is produced.

36. The system of claim 2 and conveyor means for delivering solid fuel in metered amounts to a position above said grate set at a relatively steep angle.

37. The system of claim 2 wherein each grate has tip ends with an upper angle on the order of 60° and a lower angle in the order of 30°.

38. The system of claim 2 and conveyor means for delivering solid fuel in metered amounts to a position above said grate set at a relatively steep angle.

39. The system of claim 2 wherein each grate has tip ends with an upper angle on the order of 60° and a lower angle in the order of 30°.

* * * * *